US010058986B1

(12) United States Patent
Hu

(10) Patent No.: US 10,058,986 B1
(45) Date of Patent: Aug. 28, 2018

(54) STAPLER

(71) Applicant: APEX MFG. CO., LTD., Taichung (TW)

(72) Inventor: Chih-Wei Hu, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 0 days.

(21) Appl. No.: 15/945,257

(22) Filed: Apr. 4, 2018

(51) Int. Cl.

| | |
|---|---|
| ***B25C 7/00*** | (2006.01) |
| ***A45F 5/00*** | (2006.01) |
| ***A45F 5/02*** | (2006.01) |
| *B25C 5/02* | (2006.01) |

(52) U.S. Cl.
CPC ..... *B25C 7/00* (2013.01); *A45F 5/021* (2013.01); *A45F 2005/002* (2013.01); *A45F 2200/0575* (2013.01); *B25C 5/0285* (2013.01)

(58) Field of Classification Search
CPC . A45F 2200/0575; B25C 7/00; Y10S 224/904
USPC ..... 224/269
See application file for complete search history.

(56) References Cited

U.S. PATENT DOCUMENTS 1,824,941 A * 9/1931 Winder ..... B66C 1/34 248/339
4,787,145 A * 11/1988 Klicker ..... B27B 9/00 248/291.1
4,962,873 A * 10/1990 Schattel ..... A45F 3/14 224/268
5,044,038 A * 9/1991 Matkovic ..... A46B 17/00 15/159.1
5,201,445 A * 4/1993 Axelman ..... A45F 5/02 224/148.6
5,924,667 A * 7/1999 Grahn ..... F21L 15/14 248/304
6,010,103 A * 1/2000 Ashworth ..... B25C 7/00 173/171
6,679,406 B2 * 1/2004 Sakai ..... B25B 23/045 173/217
6,905,052 B2 * 6/2005 Sakai ..... B25B 23/045 173/217
7,111,364 B2 * 9/2006 Bader ..... B25F 5/02 16/110.1
7,222,767 B1 * 5/2007 Yang ..... A45F 5/021 173/170
7,231,990 B2 * 6/2007 Lai ..... B25F 5/00 173/170
7,318,487 B2 * 1/2008 Liao ..... B25F 5/00 16/436

(Continued)

*Primary Examiner* — Justin Larson
(74) *Attorney, Agent, or Firm* — Muncy, Geissler, Olds & Lowe, P.C.

(57) ABSTRACT

A stapler having hook includes a main body, a striking mechanism, and a hook. The main body has a first end and a second end. The main body has a receiving portion at the second end. The receiving portion has a positioning portion. The striking mechanism is disposed on the first end of the main body to strike at least one nail out. The hook includes a pivot portion and a hook portion. The pivot portion is pivotally connected to the receiving portion so that the hook is slidable between a first position and a second position. The hook portion is received in the receiving portion when the hook is located at the first position. The hook portion is exposed out of the receiving portion for hanging when the hook is located at the second position.

13 Claims, 10 Drawing Sheets

(56) References Cited

U.S. PATENT DOCUMENTS 7,344,054 B2 * 3/2008 Sakai ..... B25B 23/045 173/217
7,490,746 B2 * 2/2009 Sakai ..... B25B 23/045 224/268
7,565,989 B2 * 7/2009 Lai ..... A45F 5/02 224/268
7,681,661 B2 * 3/2010 Sakai ..... B25B 21/02 173/217
7,942,299 B2 * 5/2011 Steinbrunner ..... B25C 7/00 224/269
8,087,556 B2 * 1/2012 Oomori ..... B25C 7/00 224/269
D654,783 S * 2/2012 Warren ..... D8/367
8,308,034 B2 * 11/2012 Shibata ..... B25F 5/02 224/255
8,443,913 B2 * 5/2013 Nagasaka ..... B25F 5/02 173/171
8,534,375 B2 * 9/2013 Matsumoto ..... B25F 5/02 16/110.1
8,573,322 B2 * 11/2013 Nagasaka ..... B25F 5/02 173/171
8,740,255 B1 * 6/2014 Harris ..... F16L 37/00 224/269
8,752,744 B2 * 6/2014 Okouchi ..... B25F 5/02 224/268
8,960,635 B2 * 2/2015 Brendel ..... B25F 5/02 224/268
8,985,413 B1 * 3/2015 Selsor ..... A45F 5/021 224/269
8,998,057 B2 * 4/2015 Gathers ..... A45F 5/021 224/269
9,457,461 B2 * 10/2016 Francis ..... B23D 45/16
9,522,464 B2 * 12/2016 Segura ..... B25F 5/02
9,889,547 B2 * 2/2018 Marks ..... B25C 7/00
2003/0066666 A1 * 4/2003 Etter ..... B25F 5/02 173/170
2004/0050888 A1 * 3/2004 Warner ..... A45F 5/00 224/269
2004/0156190 A1 * 8/2004 Tsuruta ..... B23B 51/00 362/119
2005/0015935 A1 * 1/2005 Bader ..... B25F 5/02 16/430
2005/0092792 A1 * 5/2005 Sakai ..... B25B 23/045 224/269
2005/0133552 A1 * 6/2005 Lawrence ..... A45F 5/02 224/269
2006/0081667 A1 * 4/2006 Lai ..... A45F 5/02 224/269
2006/0091168 A1 * 5/2006 Ng ..... A45F 5/02 224/269
2006/0104735 A1 * 5/2006 Zeiler ..... B25F 5/021 408/241 R
2007/0102462 A1 * 5/2007 Sakai ..... B25B 23/045 224/269
2008/0000939 A1 * 1/2008 Walsh ..... A45F 5/02 224/269
2008/0169395 A1 * 7/2008 Bullock ..... B60P 7/0807 248/304
2008/0185410 A1 * 8/2008 Oomori ..... B25C 7/00 224/269
2009/0134191 A1 * 5/2009 Phillips ..... A45F 5/02 224/269
2009/0277939 A1 * 11/2009 Ou ..... B25C 7/00 224/269
2013/0043295 A1 * 2/2013 Gathers ..... A45F 5/021 227/130
2014/0097217 A1 * 4/2014 Walsh ..... A45F 5/021 224/268
2014/0097326 A1 * 4/2014 Brendel ..... B25F 5/02 248/692

* cited by examiner

STAPLER

BACKGROUND OF THE INVENTION

Field of the Invention

The present invention relates to a stapler.

Description of the Prior Art

Generally, the stapler or the nailing gun is rarely used continuously for a long time. That is, it is inconvenient that the user usually takes up the stapler and pulls down the stapler frequently. Especially, it is much inconvenient that the stapler is placed at somewhere the user cannot reach easily.

To solve the problem, some staplers are disposed with hooks at its terminal end, such as patents TW M285431, TW M335360, TW M349827, or TW M512477. The hook is used to hang the stapler on the belt of the user when the user is not using the stapler.

However, the hook is always exposed out of the stapler to obstruct the operation. Also, the hook may hurt the user. Besides, the hook has a complicated structure and costs much.

SUMMARY OF THE INVENTION

The main object of the present invention is to provide a stapler having hook easy to store and use. In addition, the stapler has a simple structure and costs less.

To achieve the above and other objects, the stapler of the present invention includes a main body, a striking mechanism, and a hook.

The main body has a first end and a second end. The main body has a receiving portion at the second end. The receiving portion has a positioning portion. The striking mechanism is disposed on the first end of the main body to strike at least one nail out. The hook includes a pivot portion and a hook portion. The pivot portion is pivotally connected to the receiving portion so that the hook is slidable between a first position and a second position. The hook portion is received in the receiving portion when the hook is located at the first position. The hook portion is exposed out of the receiving portion for hanging when the hook is located at the second position.

Thereby, the hook of the present invention can be stored completely to avoid from obstructing working.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
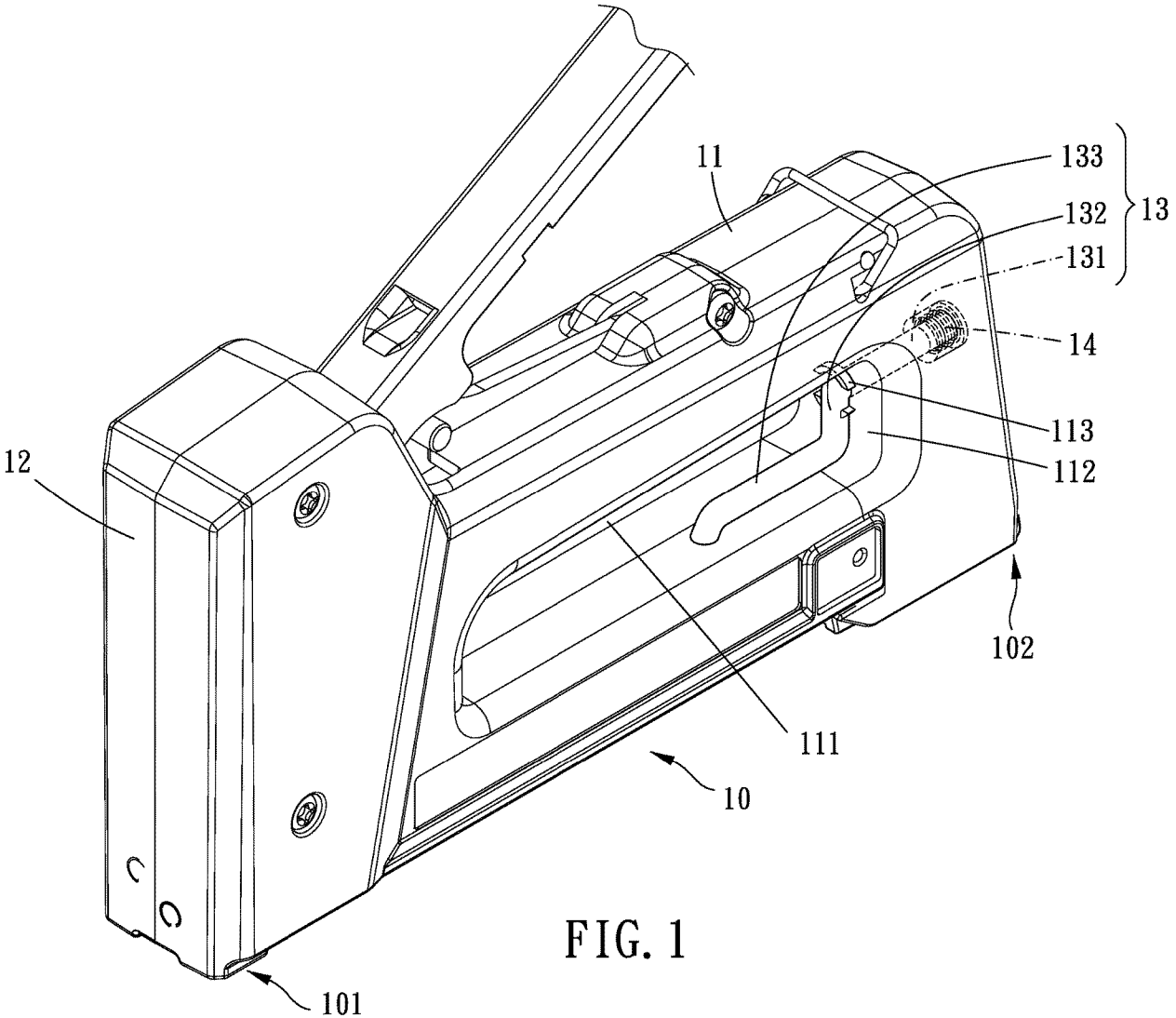
FIG. 1 is a stereogram of the present invention.
Figure 2:
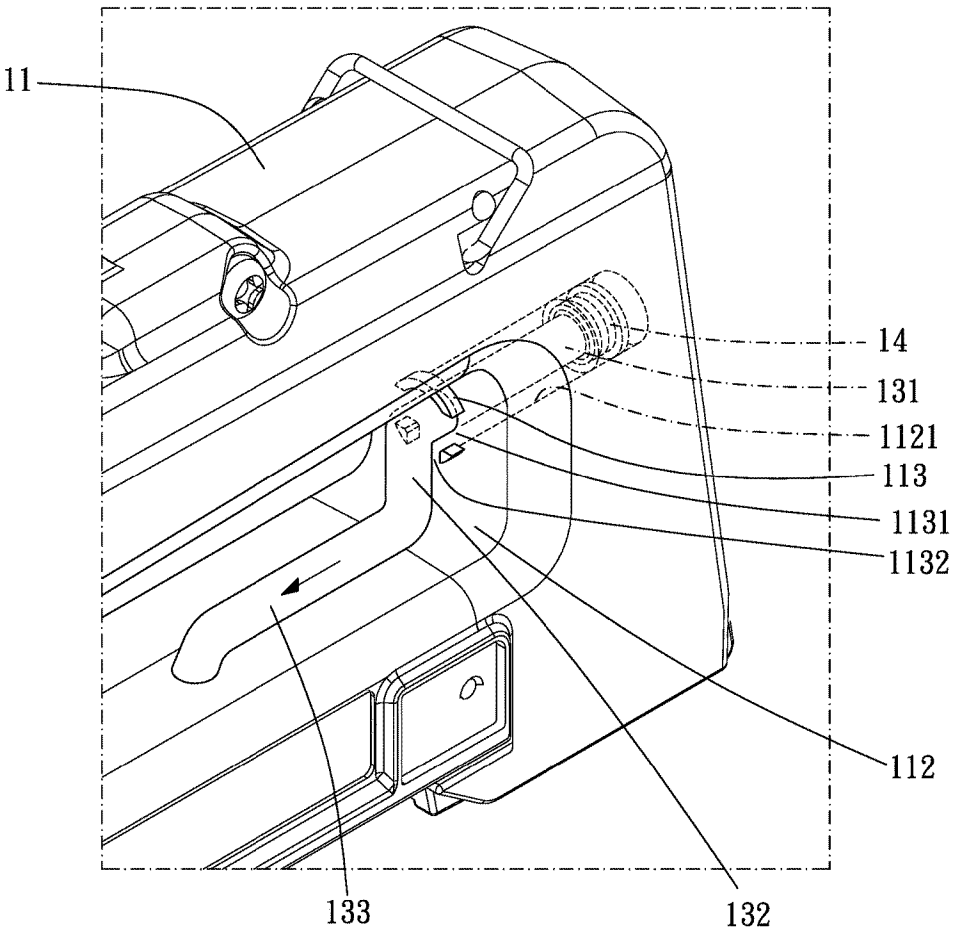
FIG. 2 is a partial stereogram of the present invention.
Figure 3:
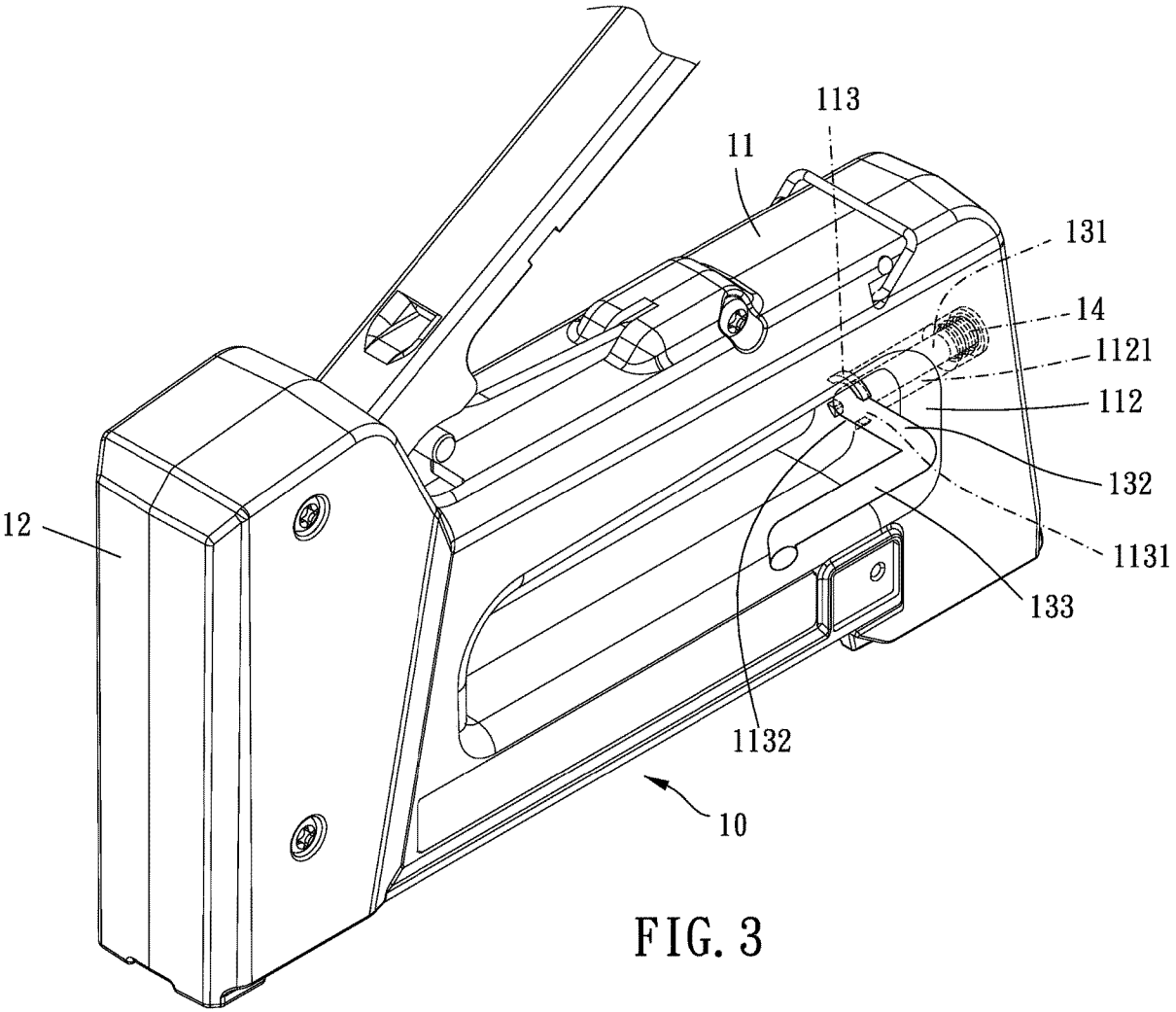
FIG. 3 is an illustration of the present invention.
Figure 4A:
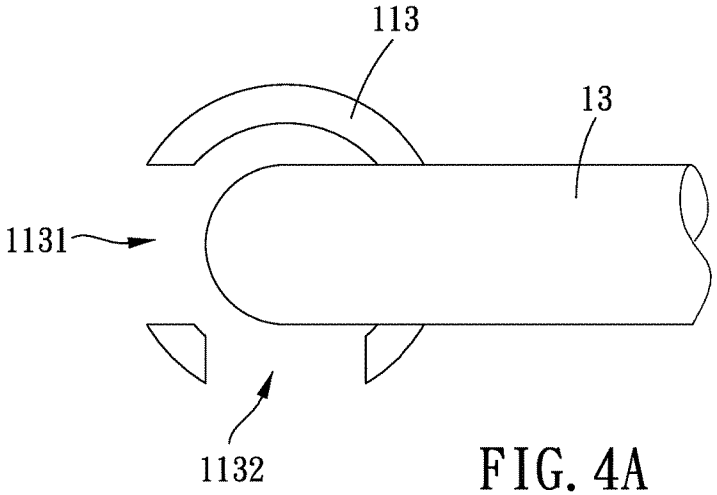
FIGS. 4, 4A, and 4B are illustrations of the present invention.
Figure 4B:
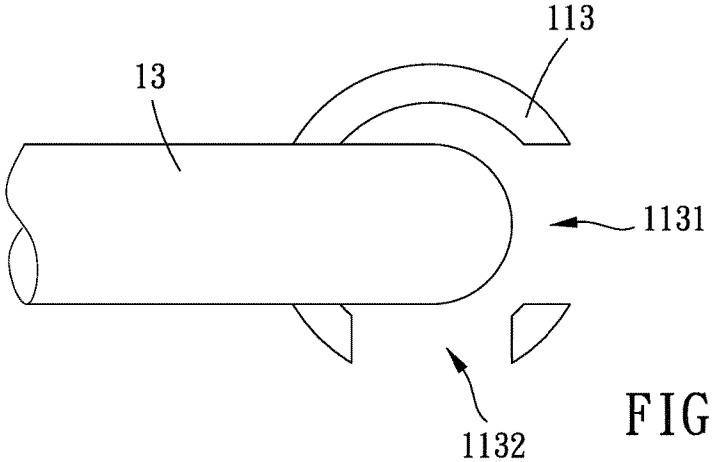
Figure 4:
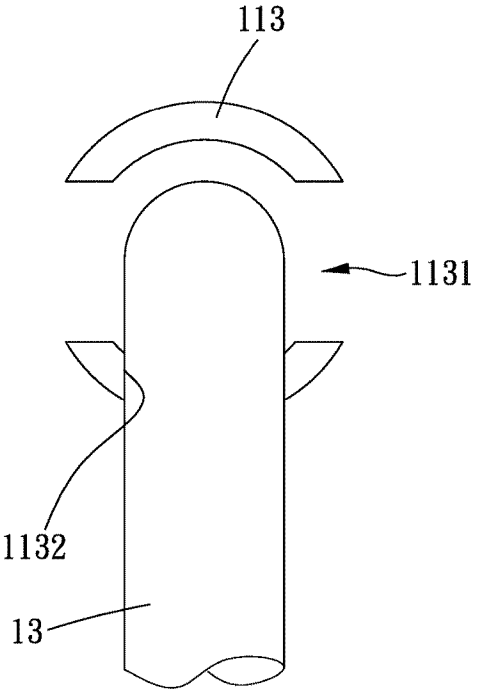
Figure 5:
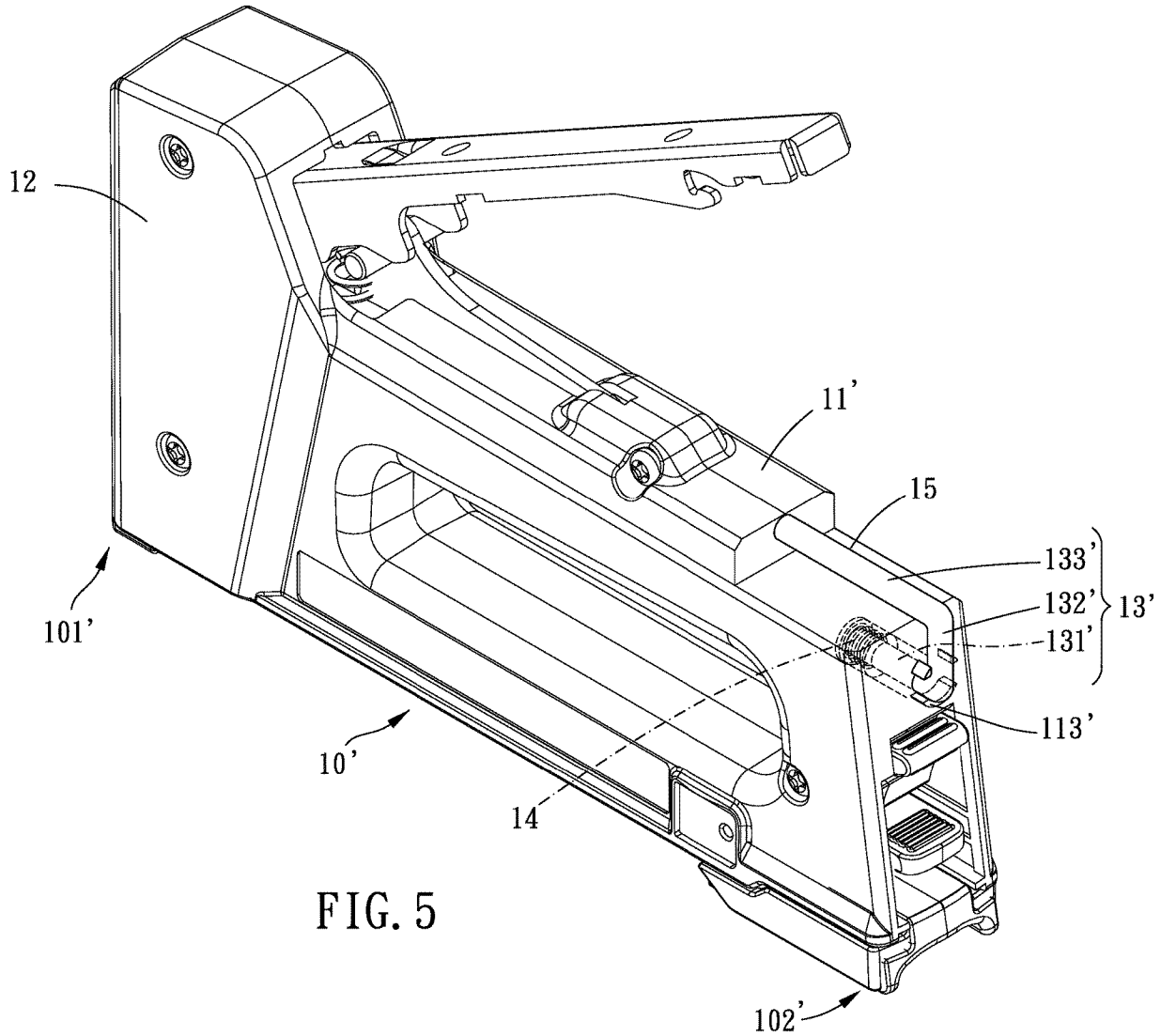
FIG. 5 is a stereogram showing a second embodiment of the present invention.
Figure 6:
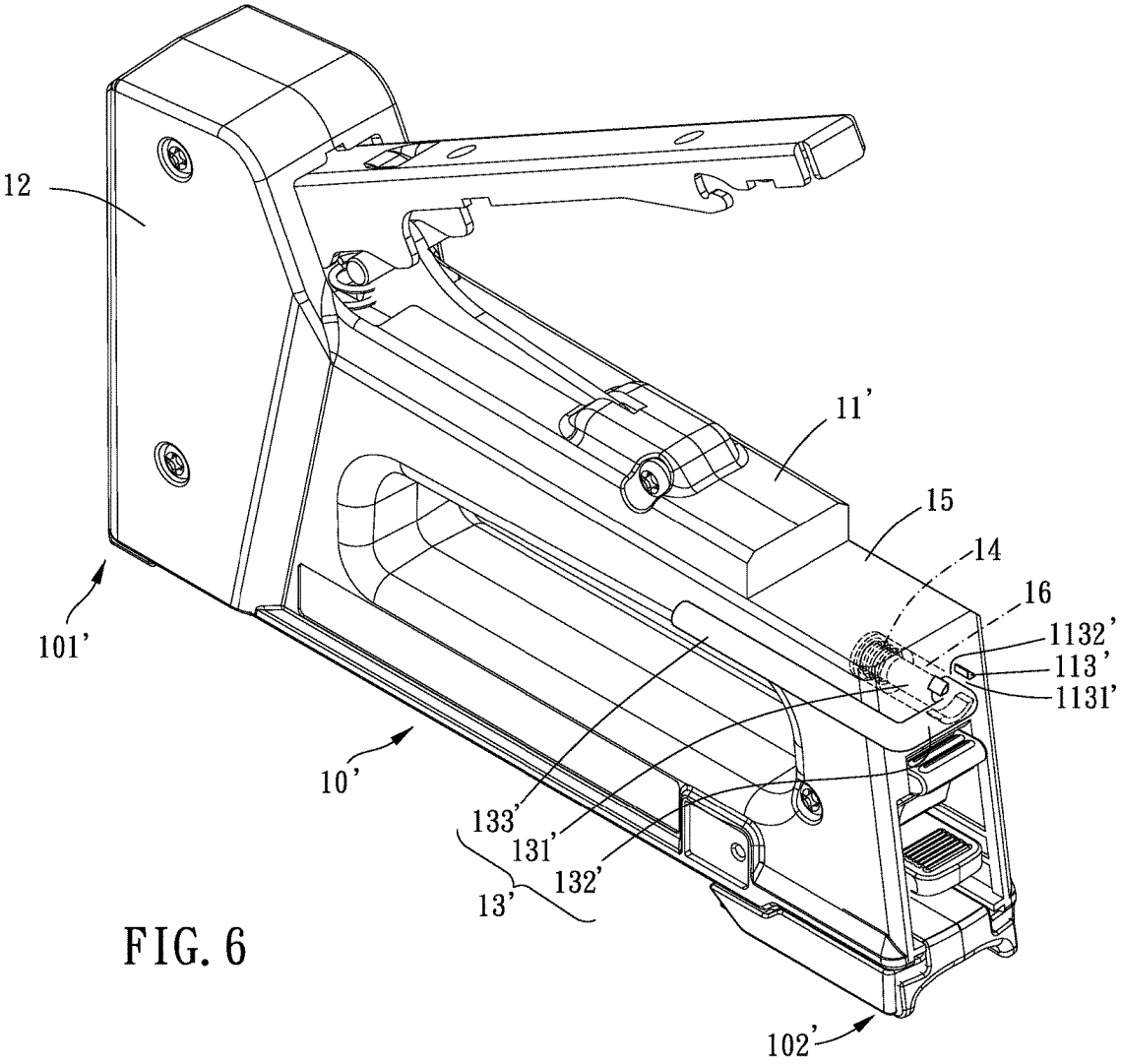
FIGS. 6 and 7 are illustrations showing a second embodiment of the present invention.
Figure 7:
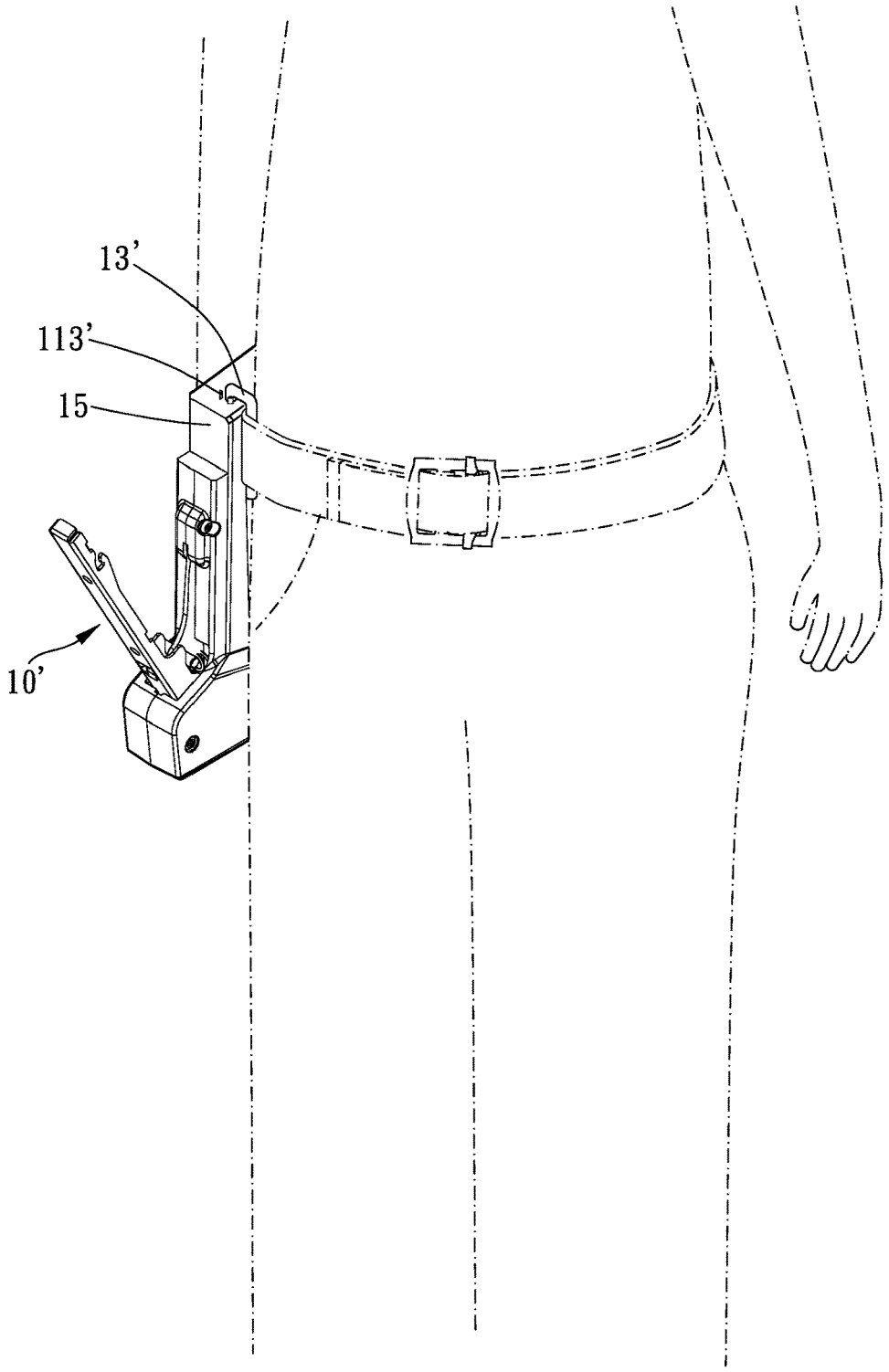

Please refer to FIG. 1 to FIG. 7, the stapler 10,10' of the present invention includes a main body 11,11', a striking mechanism 12, and a hook 13,13'.

The main body 11,11' has a first end 101,101' and a second end 102,102'. The main body 11,11' has a receiving portion at the second end. The first end 101,101' and the second end 102,102' define a longitudinal direction. The receiving portion has a positioning portion. The striking mechanism 12 is disposed on the first end 101,101' of the main body 11,11' to strike at least one nail out. The hook 13,13' includes a pivot portion 131,131' and a hook portion. The pivot portion 131,131' is pivotally connected to the receiving portion so that the hook 13,13' is slidable between a first position and a second position. When the hook 13,13' is located at the first position, the hook portion is received in the receiving portion. When the hook 13,13' is located at the second position, the hook portion is exposed out of the receiving portion for hanging. The positioning portion fixes the hook 13,13' at the first position or the second position to prevent the hook 13,13' from pivoting freely.

In the present embodiment as shown in FIG. 1, FIG. 4, FIG. 4A, and FIG. 4B, the receiving portion is a through hole 111 of the main body 11. An extending direction of the through hole 111 is perpendicular to the longitudinal direction. A side of an inner wall of the through hole 111 closer to the second end 102 is defined as a lateral face 112. The lateral face 112 faces the first end 101. The pivot portion 131 of the hook 13 is pivotally connected to the lateral face 112. The hook portion extends toward the first end 101. When the hook 13 is located at the first position, the hook portion is received in the through hole 111. When the hook 13 is located at the second position, the hook portion is exposed out of the through hole 111. More specifically, the hook portion of the hook 13 includes a connection section 132 and a hook section 133. The connection section 132 connects the pivot portion 131 and the hook section 133 therebetween. The hook section 133 extends toward the first end 101 and is located at a line different from the pivot portion 131.

Besides, the positioning portion includes a plurality of protrusions 113 formed on the lateral face 112 to surround the pivot portion 131 of the hook 13. The protrusions 113 are arranged spacedly to define at least two grooves. The connection section 132 of the hook 13 is received in one of the at least two grooves selectively to position the hook 13 at the first position or the second position so that the stapler 10 may not pivot freely when hung. Preferably, the hook 13 is made of flexible material, such as reinforced plastic or nylon. Thus, the hook 13 can be pulled to make the connection section 132 stride over the protrusion 113 so that the hook 13 becomes pivotable. However, an elastic element 14 can be used too. More specifically, the lateral face 112 is formed with a receiving hole 1121, and the protrusions 113 are arranged around the receiving hole 1121. The pivot portion 131 and the elastic element 14 are inserted into the receiving hole 1121 so that the hook 13 tends to move toward the lateral face 112.

Preferably, the positioning portion includes three said protrusion 113. The three protrusions 113 define three grooves thereamong. The three grooves are a lower groove 1132 and two lateral grooves 1131. The hook 13 is located at the first position when the connection section 132 is received in the lower groove 1132. The hook 13 is located at the second position or a third position when the connection section 132 is received in one of the lateral grooves 1131. The hook section 132 is located at two sides of the through hole 111 when the hook 13 is located at the second position or the third position. That is, the connection section 132 pivots 90 degrees between the first position and each of the second position and the third position.

In another embodiment of the present invention, the hook is connected to the main body in another way. Please refer to FIG. 5 to FIG. 7, the receiving portion is a notch 15 of the main body 11'. The notch 15 is located at a top of the second end 102' of the main body 11'. The notch 15 includes a bottom face and a lateral face facing the second end 102'. The pivot portion 131' of the hook 13' is pivotally connected to a terminal face of the second end 102' of the main body 11'. The hook portion of the hook 13' includes a connection section 132' and a hook section 133'. The connection section 132' connects the pivot portion 131' and the hook section 133' therebetween. The hook section 133' extends toward the first end 101' and is located at a line different from the pivot portion 131' so that the hook 13 is U-shaped. The hook portion 133' is received in the notch 15 when the hook 13' is located at the first position. The hook 13' is exposed out of the notch 15 when the hook 13' is located at the second position. Besides, the positioning portion includes a plurality of protrusions 113' formed on a terminal face of the second end 102' of the main body 11' to surround the pivot portion 131' of the hook 13'. The protrusions 113' are arranged spacedly to define at least two grooves. The connection section 132' of the hook 13' is received in one of the at least two grooves selectively to position the hook 13' at the first position or the second position. Preferably, the hook 13' is made of flexible material, such as reinforced plastic or nylon. Thus, the hook 13' can be pulled to stretch to stride over the protrusions 113' so that the hook 13' becomes pivotable. However, an elastic element 14 can be used too. More specifically, the terminal face of the second end 102' is formed with a receiving hole 16, and the protrusions 113' are arranged around the receiving hole 16. The pivot portion 131' and the elastic element 14 are inserted into the receiving hole 16 so that the hook 13' tends to move toward the terminal face of the second end 102' Preferably, the positioning portion includes three said protrusion 113'. The three protrusions 113' define three grooves thereamong. The three grooves are an upper groove 1132' and two lateral grooves 1131'. The hook 13' is located at the first position when the connection section 132' is received in the upper groove 1132'. The hook 13' is located at the second position or a third position when the connection section 132' is received in one of the lateral grooves 1131'. The hook section 133' is located at two sides of the notch 15 when the hook 13' is located at the second position or the third position. That is, the connection section 132' pivots 90 degrees between the first position and each of the second position and the third position.

Figure 9:
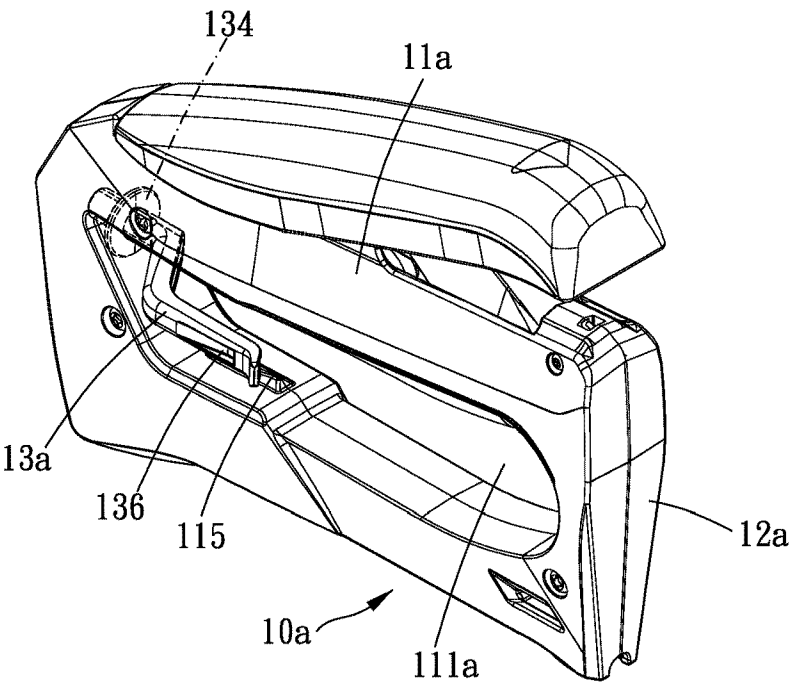
FIG. 9 is an illustration showing a third embodiment of the present invention.
Figure 8:
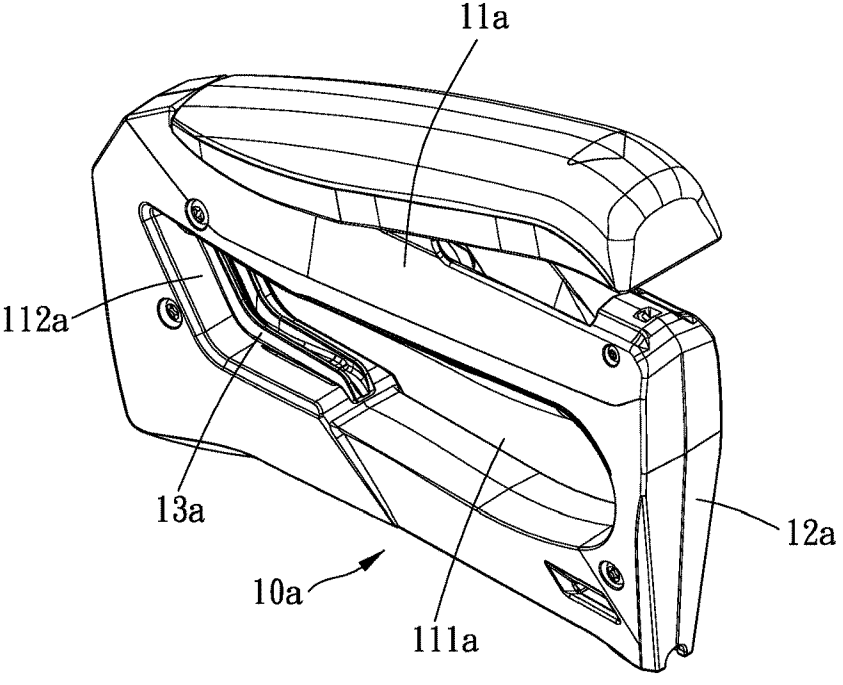
FIG. 8 is a stereogram showing a third embodiment of the present invention.
Figure 11:
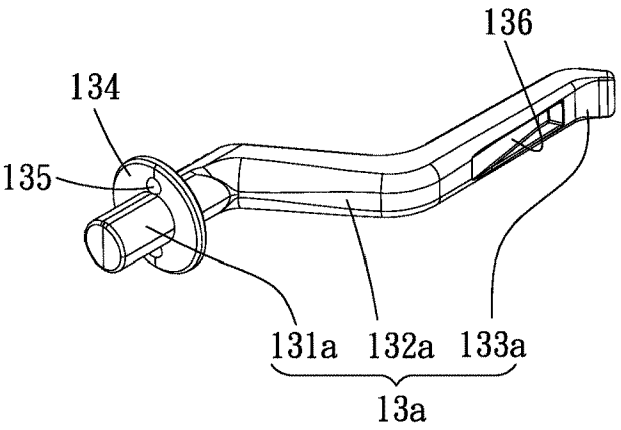
FIG. 11 is a stereogram of a hook showing a third embodiment of the present invention.
Figure 10:
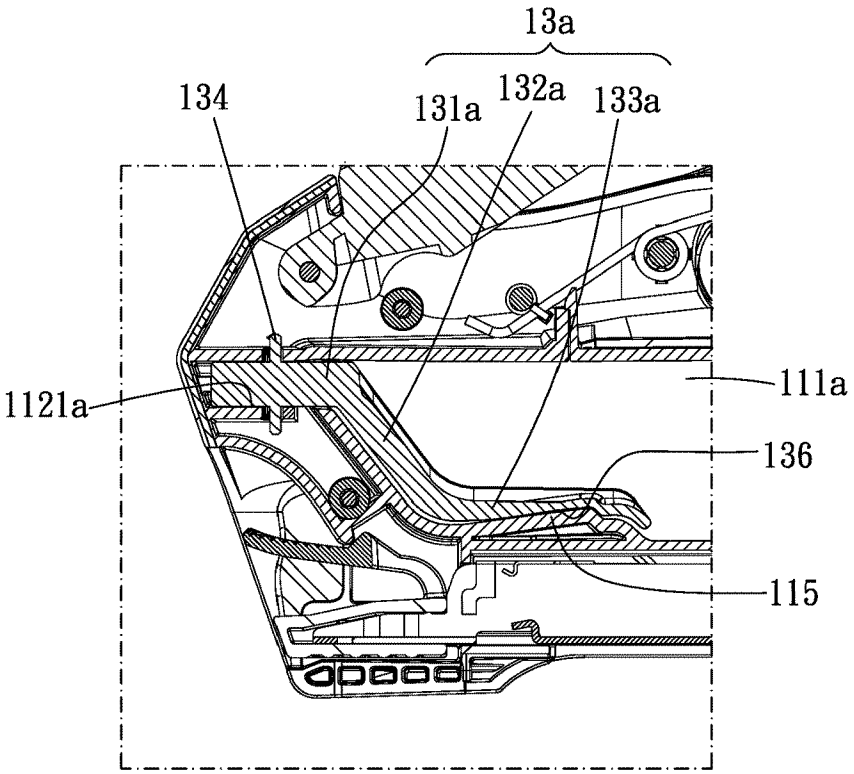
FIG. 10 is a partial profile showing a third embodiment of the present invention.
Figure 13:
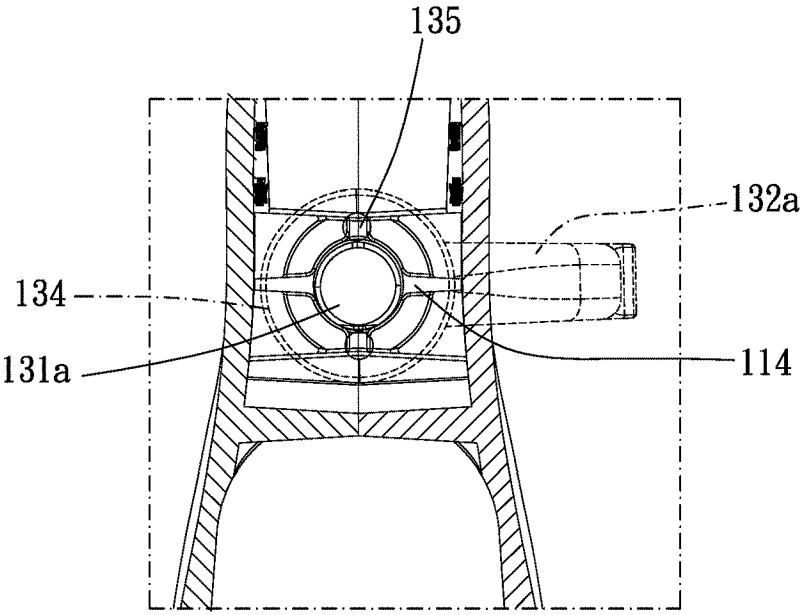
FIGS. 12 and 13 are illustrations showing a third embodiment of the present invention.
Figure 12:
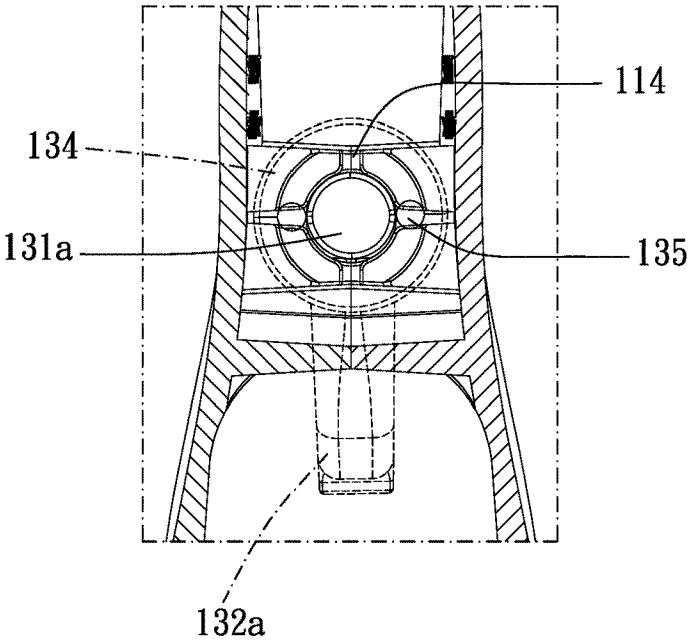

Please refer to FIG. 8 to FIG. 13 for another embodiment of the present invention. The main body 11*a* of the stapler 10*a* has a receiving portion at the second end. The receiving portion has a positioning portion. The receiving portion includes a through hole 111*a*. A lateral face 112*a* is defined as a side of the inner wall of the through hole 111*a* closer to the second end. The lateral face 112*a* faces the first end. The striking mechanism 12*a* is disposed on the first end of the main body 10*a* to strike at least one nail out. The hook 13*a* includes a pivot portion 131*a*, a connection section 132*a*, and a hook section 133*a*. The pivot portion 131*a* is inserted into a receiving hole 1121*a* on the lateral face 112*a*. An intermediate portion of the receiving hole 1121*a* is open radially. Four positioning grooves 114 are formed on a terminal face of the intermediate portion of the receiving hole 1121*a* facing the through hole 111*a*. The four positioning grooves 114 are arranged annularly to be located at three o'clock position, six o'clock position, nine o'clock position, and twelve o'clock position respectively. An intermediate portion of the pivot portion 131*a* of the hook 13*a* is formed with an annular flange 134 extending radially and outwardly. At least two positioning protrusions 135 are formed on a face of the annular flange 134 opposite to the connection section 132*a*. The at least two positioning protrusions 135 positionally correspond to two of the positioning grooves 114 not adjacent to each other to be selectively positioned in the positioning grooves 114 at three and nine o'clock or positioning grooves 114 at six and twelve o'clock so that the hook 13*a* is pivotable around the longitudinal direction between the first position and the second position. The hook portion is received in the receiving portion when the hook 13*a* is located at the first position. The hook portion is exposed out of the receiving portion for hanging when the hook 13*a* is located at the second position. The positioning portion positions the hook 13*a* at the first position or the second position to prevent the hook 13*a* from pivoting freely. Specifically, the hook 13*a* can be made of elastic material to be pulled to change the positioning grooves 114 that the positioning protrusions 135 are embedded in.

Besides, a bottom face of the through hole 111*a* is formed with a positioning protruding portion 115. The hook section 133*a* of the hook 13*a* is formed with a positioning recessed portion 136. The positioning protruding portion 115 is positioned in the positioning recessed portion 136 to prevent the hook 13*a* from pivoting freely when the hook is located at the first position.

Thereby, the hook can be stored in the receiving portion completely when not in use, and the operation is easy. In addition, the structure is simple and easy to manufacture.

What is claimed is:

1. A stapler having hook, including:

a main body, having a first end and a second end, the main body having a receiving portion at the second end, the receiving portion having a positioning portion;

a striking mechanism, disposed on the first end of the main body to strike at least one nail out;

a hook, including a pivot portion and a hook portion, the pivot portion being pivotally connected to the receiving portion so that the hook is slidable between a first position and a second position, the hook portion being received in the receiving portion when the hook is located at the first position, the hook portion being exposed out of the receiving portion for hanging when the hook is located at the second position.

2. The stapler having hook of claim 1, wherein the positioning portion fixes the hook at the first position or the second position to prevent the hook from pivoting freely.

3. The stapler having hook of claim 2, wherein the first end and the second end defines a longitudinal direction, the receiving portion is a through hole of the main body, an extending direction of the through hole is perpendicular to the longitudinal direction, a side of an inner wall of the through hole closer to the second end is defined as a lateral face, the lateral face faces the first end, the pivot portion of the hook is pivotally connected to the lateral face, the hook portion extends toward the first end, the hook portion is received in the through hole when the hook is located at the first position, the hook portion is exposed out of the through hole when the hook is located at the second position.

4. The stapler having hook of claim 3, wherein the hook portion of the hook includes a connection section and a hook section, the connection section connects the pivot portion and the hook section therebetween, the hook section extends toward the first end and is located at a line different from the pivot portion.

5. The stapler having hook of claim 4, wherein the positioning portion includes a plurality of protrusions formed on the lateral face to surround the pivot portion of the hook, the protrusions are arranged spacedly to define at least two grooves, the connection section of the hook is received in one of the at least two grooves selectively to position the hook at the first position or the second position.

6. The stapler having hook of claim 5, wherein the hook is made of flexible material.

7. The stapler having hook of claim 5, wherein the positioning portion includes three said protrusion, the three protrusions define three grooves thereamong, the three grooves are a lower groove and two lateral grooves, the hook is located at the first position when the connection section is received in the lower groove, the hook is located at the second position or a third position when the connection section is received in one of the lateral grooves, the hook section is located at two sides of the through hole when the hook is located at the second position or the third position.

8. The stapler having hook of claim 2, wherein the receiving portion is a notch of the main body, the notch is located at a top of the second end of the main body, the notch includes a bottom face and a lateral face facing the second end, the pivot portion of the hook is pivotally connected to a terminal face of the second end of the main body, the hook portion of the hook includes a connection section and a hook section, the connection section connects the pivot portion and the hook section therebetween, the hook section extends toward the first end is located at a line different from the pivot portion so that the hook is U-shaped, the hook portion is received in the notch when the hook is located at the first position, the hook is exposed out of the notch when the hook is located at the second position.

9. The stapler having hook of claim 8, wherein the positioning portion includes a plurality of protrusions formed on a terminal face of the second end of the main body to surround the pivot portion of the hook, the protrusions are arranged spacedly to define at least two grooves, the connection section of the hook is received in one of the at least two grooves selectively to position the hook at the first position or the second position.

10. The stapler having hook of claim 9, wherein the hook is made of flexible material.

11. The stapler having hook of claim 9, wherein the positioning portion includes three said protrusion, the three protrusions define three grooves thereamong, the three grooves are an upper groove and two lateral grooves, the hook is located at the first position when the connection section is received in the upper groove, the hook is located at the second position or a third position when the connection section is received in one of the lateral grooves, the hook section is located at two sides of the notch when the hook is located at the second position or the third position.

12. The stapler having hook of claim 4, wherein the pivot portion is inserted into a receiving hole on the lateral face, an intermediate portion of the receiving hole is open radially, four positioning grooves are formed on a terminal face of the intermediate portion of the receiving hole facing the through hole, the four positioning grooves are arranged annularly to be located at three o'clock position, six o'clock position, nine o'clock position, and twelve o'clock position respectively, an intermediate portion of the pivot portion of the hook is formed with an annular flange extending radially and outwardly, at least two positioning protrusions are formed on a face of the annular flange opposite to the connection section, the at least two positioning protrusions positionally correspond to two of the positioning grooves not adjacent to each other to be selectively positioned in the positioning grooves at three and nine o'clock or positioning grooves at six and twelve o'clock so that the hook is pivotable around the longitudinal direction between the first position and the second position, the hook portion is received in the receiving portion when the hook is located at the first position, the hook portion is exposed out of the receiving portion for hanging when the hook is located at the second position, the positioning portion positions the hook at the first position or the second position to prevent the hook from pivoting freely.

13. The stapler of claim 12, wherein a bottom face of the through hole is formed with a positioning protruding portion, the hook section of the hook is formed with a positioning recessed portion, the positioning protruding portion is positioned in the positioning recessed portion to prevent the hook from pivoting freely when the hook is located at the first position.

* * * * *